US005823837A

United States Patent [19]

Boatman et al.

[11] Patent Number: 5,823,837

[45] Date of Patent: Oct. 20, 1998

[54] TURRET MOORING SYSTEM WITH PRODUCT SWIVEL STACK

[75] Inventors: L. Terry Boatman; Miles A. Hobdy, both of Houston, Tex.

[73] Assignee: FMC Corporation, Chicago, Ill.

[21] Appl. No.: 975,230

[22] Filed: Nov. 20, 1997

[51] Int. Cl.[6] ..... B62B 22/02

[52] U.S. Cl. ..... 441/5; 114/230

[58] Field of Search ..... 441/3–5; 114/230, 114/293; 137/615

[56] References Cited

U.S. PATENT DOCUMENTS

| | | |
|---|---|---|
| 3,100,538 | 8/1963 | Sanders . |
| 3,614,869 | 10/1971 | Flory et al. . |
| 3,648,311 | 3/1972 | Voss . |
| 3,698,433 | 10/1972 | Dobler et al. . |
| 3,823,432 | 7/1974 | Van Heijst . |
| 3,942,204 | 3/1976 | Gruy . |
| 3,969,781 | 7/1976 | Reid, Jr. . |
| 4,052,090 | 10/1977 | Stafford . |
| 4,126,336 | 11/1978 | Ortloff et al. . |
| 4,310,937 | 1/1982 | Karl et al. . |
| 4,453,859 | 6/1984 | Sedillot et al. . |
| 4,459,930 | 7/1984 | Flory . |
| 4,602,586 | 7/1986 | Ortloff . |
| 4,665,855 | 5/1987 | Delamare . |
| 4,701,143 | 10/1987 | Key et al. . |
| 4,955,310 | 9/1990 | Pollack . |
| 5,065,689 | 11/1991 | Krogstad . |
| 5,205,768 | 4/1993 | Pollack . |
| 5,288,253 | 2/1994 | Urdshals et al. . |
| 5,651,708 | 7/1997 | Borseth ..... 441/5 |

FOREIGN PATENT DOCUMENTS

WO 9502146 1/1995 WIPO .

OTHER PUBLICATIONS

BP Exploration brochure regarding the Schiehallion project.

IBC 10th International Conference (Dec., 1995) Concerning Floating Production Systems.

*Primary Examiner*—Stephen Avila

*Attorney, Agent, or Firm*—Bush, Riddle, & Jackson L.L.P.

[57] ABSTRACT

A storage vessel (10) in a mooring system has a moon pool (14) and a turret (12) rotatively mounted thereon, with the turret anchored to the sea floor. A swivel stack (16) has an inner male core (18) mounted on bearings (80) which are supported on turret (12). Vertically spaced swivels (110) each has an outer female housing (112) mounted on inner male core which define a stacked inner male core (18). The stacked inner male core (18) weathervanes with vessel (10) about turret (12) and outer female housings (112). Inlet product lines (26, 120) in fluid communication with risers (24) are coupled to outer female housings (112); outlet product lines (28) are coupled to the stacked inner male core (18). Outlet products lines (28) extend via the upper end of central bore (79) in inner male core (18) to storage areas of vessel (10). A plurality of manifold platforms (66, 68, 70, 72) are positioned alongside the swivel stack (16) and are secured to the turret (12).

35 Claims, 5 Drawing Sheets

130
132
6
6
28
142
144
18
16
114
138
134
110
72
64
138
74
74
140
110
70
138
120
114
116
74
68
138
28
110
94
80
140
32
98
66
138
102
65
140
34
56
65
38
13
10
36
26
26
60
58
60
58
58
62
48
54
47
14
14
30
12
L
46
52
44
42
40
44
22
23
24
24

28
18
142
144
120
16
114
112
116
72
122
110
120
120
112
110
70
122
120
114
112
110
68
18
78
68
80
94
32
106
66
96
66
100
98
102
26
88
104
106
56
34
38
65
36
12
30

TURRET MOORING SYSTEM WITH PRODUCT SWIVEL STACK

BACKGROUND OF THE INVENTION

1. Field of the Invention

This invention relates to a turret moored vessel having a product swivel stack mounted on a turret.

2. Background of the Invention

Mooring systems are generally known in which a floating vessel includes a hull with a vertical opening therethrough for receiving a turret. The turret is anchored to the sea floor by suitable anchor legs. Bearing means on the hull or body of the vessel rotatingly couple the vessel to the turret so that the vessel may weathervane or rotate about the anchored turret in response to forces of tides, currents, winds, and the like.

Hydrocarbon product from wells on the sea bed are transported by flexible hoses, called risers which run to the turret. Fluid flow paths in the turret run from the risers to a swivel stack. Lines from the swivel stack are connected to suitable storage areas in the vessel. Accordingly, a fluid flow path is provided from each subsea well or subsea manifold to the turret, through the turret to a manifold to the turret, or directly to a fluid rotative coupling of the swivel stack and then to a vessel storage location.

A swivel stack normally has a plurality of rotative fluid couplings called "swivels" with a male inner core and an outer female housing. The male core and the female outer housing are mounted for relative rotation. It has been common in the past to place product lines from the turret inside the inner core of the swivel stack via the bottom of the swivel stack. In such prior arrangements, the inner core of the swivel stack was fixed with respect to the turret; the outer housing rotated with the vessel with its product lines running to storage holds of the vessel.

Structural platforms in the past have been secured to the turret above the deck of the vessel so that piping and manifolds connected to the risers may be mounted thereon at a location below the swivel stack in order that piping from the manifolds may be easily received within the lower end of the inner bore of the swivel stack for connection to the inner male core of the swivel stack. Because manifolds are generally provided to receive the product of multiple risers, a manifold deck is required to be provided on the turret mounted platform. Such manifold deck was placed beneath the swivel stack, because the outlet lines of the manifold ran via the bottom of the inner core of the swivel stack. As a result, the swivel stack in prior arrangements and design has been mounted above manifold decks and extend a substantial height above the main deck. Any scaffolds or platforms secured to the deck for servicing of the swivel stack also extend to substantially the same height as the swivel stack. Separate hydraulic, electrical, and control swivels are often connected to the upper end of the swivel stack which also increases the height of the swivel stack including the various lines extending to and from the separate swivels. Scaffolds or service platforms normally secured to the turret are also generally required for these separate swivels.

International Publication No. WO95/01904 published Jan. 19, 1995, shows a mooring system for a vessel in which a buoy is mounted within an opening in the vessel and has a turret anchored to the sea floor. The vessel weathervanes about the turret. A quick connect/disconnect swivel device is provided above the turret and has an outer female housing which is fixed to the turret. It has an inner male member or core which is secured to the vessel for rotation with the vessel about the turret. Risers from the sea bed are connected to the female housing; product conductors or tubes extend from the inner male member to storage areas in the vessel. Further, the inlet passage and the outlet passage for each fluid coupling of the swivel are vertically spaced from each other and are connected by a vertical passage in the male member. The swivel stack of the 95/01904 publication does not show a common swivel stack. In particular it does not show a swivel stack mounted vertically above a mooring turret and does not show a plurality of separate vertically spaced swivels with each separate swivel having an inlet connection or port and an outlet connection or port on a common horizontal level communicating via a toroidal conduit between the inner male core and the outer female housing. Furthermore, no platforms or supporting structures are provided for manifolds of riser lines or for servicing of the swivel.

SUMMARY OF THE INVENTION

The present invention is particularly directed to a mooring system and fluid rotative coupling arrangement for a floating storage vessel in which the floating vessel is rotatively coupled to a turret which is anchored to the sea bed so that the vessel can weathervane about the turret. A swivel stack is mounted on the upper end of the turret. The swivel stack includes a plurality of vertically spaced product swivels each having an inner male core which is rotatively coupled to an outer female housing which receives the inner male swivel core. Each inner male core of the stack is secured together to form a male stack core. Each outer female housing is secured together via torque arms fixed to the turret to form a female stack. The female stack of the swivel stack is fixed to the turret, with the inner male portion mounted for rotation within the female stack. The swivel stack also preferably includes a lower auxiliary section which extends from the lower end portion of the swivel stack and which includes separate hydraulic, electrical, and control swivels. A central bore extends through the inner male core stack.

Risers extend from subsea wells or manifolds and are connected to the turret. Product lines mounted on the turret extend from the risers (via manifolds if desired) to inlet ports or connections in the outer female housings of the swivel stack. Toroidal conduits extend between the outer female housing male core to the inner male core of each swivel of the stack. Outlet product lines connected from respective inner male cores of the swivel stack extend out of the upper end of the swivel stack and extend outwardly from the upper end of the swivel stack to suitable storage areas of the vessel. The outlet product lines from the swivel stack connected to the male inner core are fixed with and rotate with the vessel; the (input) product lines to the outer female housings are fixed with the turret.

The mooring turret includes a relatively small diameter upper end portion which extends upwardly from the main deck of the vessel. The inner male core of the swivel stack is rotatively mounted by means of a bearing at the upper end of the turret so that the inner male core of the swivel stack rotates with the vessel as it weathervanes about the substantially fixed turret. Vertically spaced control and manifold decks or platforms are supported at the upper end portion of the turret. Such decks extend about and are positioned alongside the turret stack. Suitable piping, manifolds, and controls are mounted on the several turret decks for servicing and connection of the inlet product lines from the turret to the outer female housings of the swivel stack. The swivel stack has a lower end portion which includes hydraulic and electrical swivels which are received within the cylindrical lower end portion of the turret. As a result of the swivel arrangement described above, the height between the top of the turret and the bottom of the swivel stack is minimized as compared with prior turret/swivel mooring arrangements with a consequential reduction in height and size for the required turret platforms.

An object of the present invention is to provide a mooring system which includes a vessel mounted for rotation about a turret and having a swivel stack mounted on the turret which extends a minimal height above the turret and main deck of the vessel.

Another object of this invention is to provide such a mooring system in which inlet product lines from risers are connected to outer female housings of a swivel stack which are fixed to the turret thereby obviating a need for inlet product lines which extend via the lower end of the central bore of the swivel stack and obviate the need for manifold decks beneath the swivel stack with a consequential minimization of the height of the support platforms above the main deck of the vessel.

Another object of the invention is to provide a plurality of vertically spaced decks which are secured to the turret and positioned alongside the swivel stack to support piping and manifolds directly adjacent the outer female housings of the swivel stack which are fixed to the turret thereby providing servicing of the swivel stack from the side of the turret stack.

A still further object of the invention is to provide outlet product lines which extend from the upper end of the swivel stack and are connected to an inner male core of the swivel stack which is fixed to the vessel, the outlet product lines extending to storage areas of the vessel thereby permitting the lower end of the swivel stack to be positioned relatively closer to the main deck of the vessel as compared to prior turret/swivel arrangements.

Other objects, features, and advantages of the invention will be apparent from the following specification and drawings.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE PREFERRED EMBODIMENT

Figure 1:
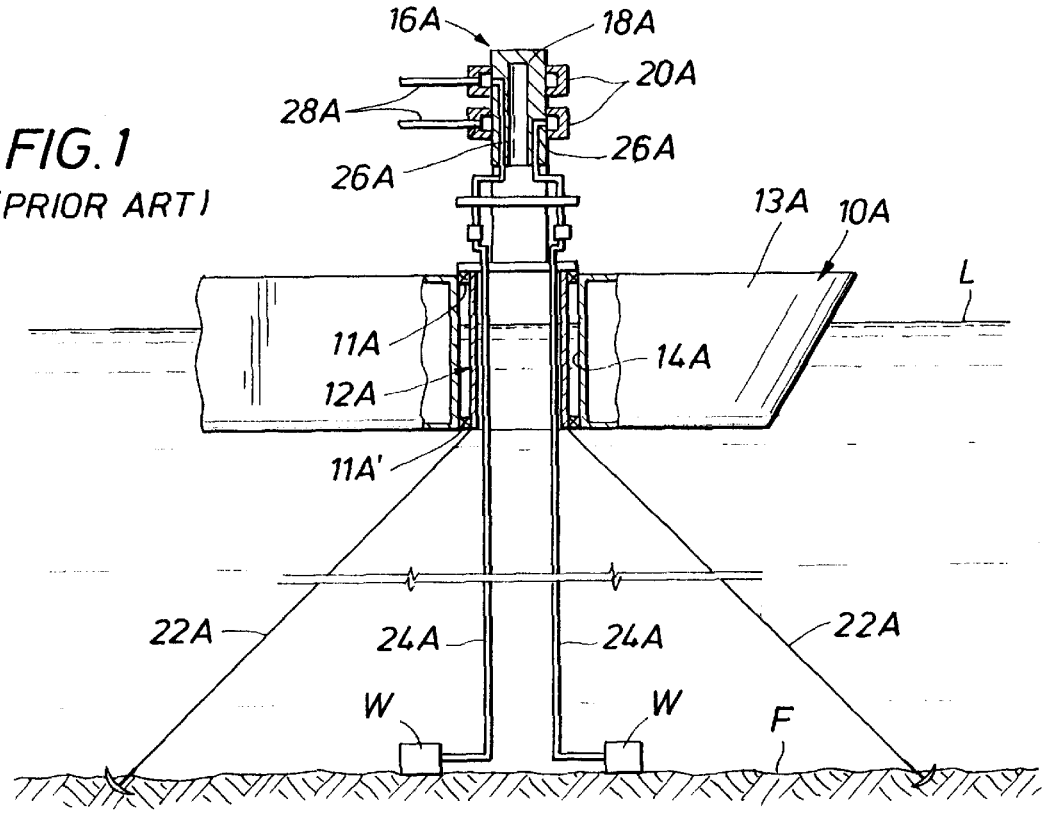
FIG. 1 (PRIOR ART)
FIG. 1 is a schematic view of a prior art mooring arrangement for a floating storage vessel in which a swivel stack is mounted on the upper end of a turret and has an inner male core fixedly mounted to the turret and connected to inlet product lines from the turret, with female outer swivel housings rotatively mounted with respect to the inner male core and the turret and connected to the outer product lines which extend to storage areas of the vessel, the arrangement permitting weathervaning of the vessel and outer female swivel housings about the turret and inner male core.
Figure 2:
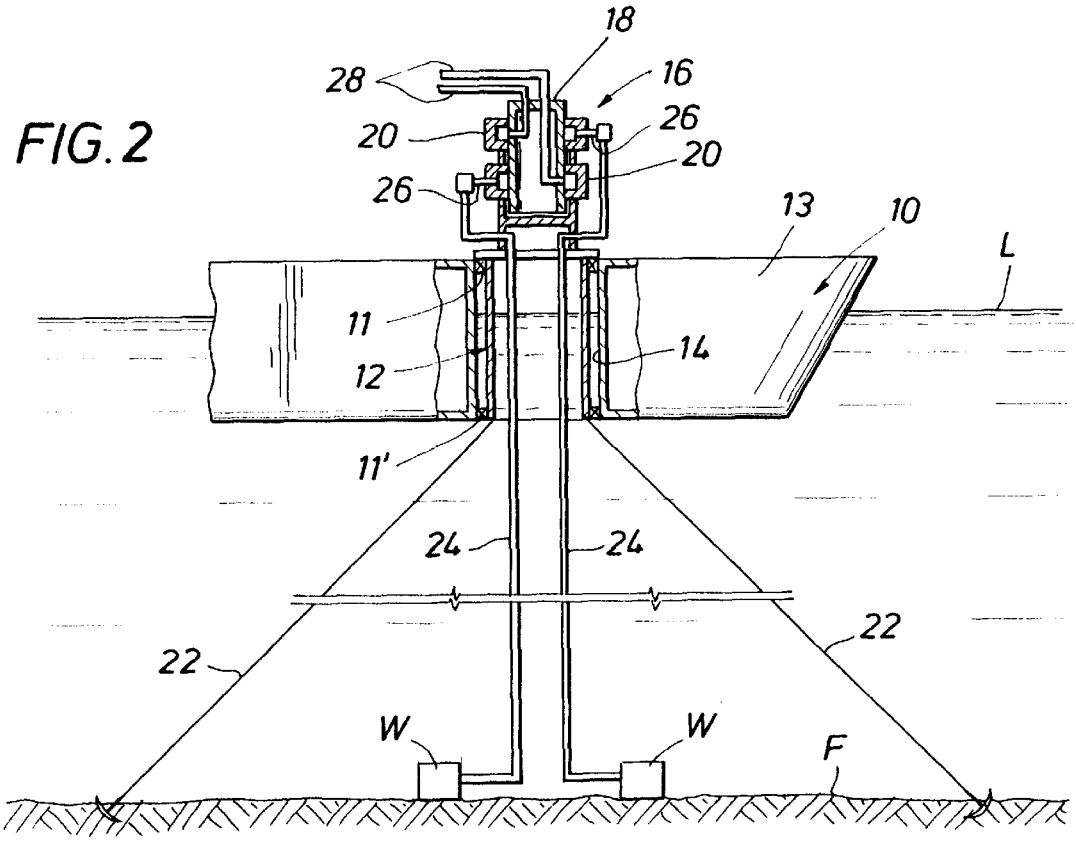
FIG. 2 is a schematic view of a mooring system for a floating storage vessel according to the present invention in which a swivel stack is mounted on the upper end of a turret and has outer female swivel housings connected to inlet product lines from the turret with an inner male core connected to outlet product lines extending from the upper end of the swivel stack to storage areas of the vessel so that the vessel and the inner male stack core can weathervane with respect to the turret and outer female swivel housings.

The present invention may be clearly understood from a comparison of FIG. 1, a schematic view of a prior art mooring system and swivel stack arrangement for a storage vessel, with FIG. 2, a schematic view of the mooring system and swivel stack arrangement for a storage vessel according to the present invention.

Description Of Prior Art Mooring System—FIG. 1

Referring first to FIG. 1, a storage vessel 10A for hydrocarbon product is shown having a turret 12A mounted within a vertical opening or moon pool 14A within hull 13A of the vessel. Sea water level shown at L extends within moon pool 14A. The sea bed is shown at F. A swivel stack 16A is mounted on turret 12A. Swivel stack 16A has a plurality of swivels each with an inner male core thereby forming a composite stacked male core 18A which is fixed to turret 12A and with each outer female housing 20A secured together and mounted for rotation relative to the stacked male core 18A. Anchor legs 22A are fixed to turret 12A and are anchored to the sea floor F. Risers 24A extend from sub sea wells W (or manifolds) and are connected to upper inlet product conduits or lines 26A which enter the swivel stack from beneath stacked male core 18A. Outlet product conduits 28A extend from outer female housings 20A to suitable holds in vessel 10A for the storage or transport of hydrocarbon product from subsea wells W. Suitable upper and lower bearings 11A and 11A' are provided between turret 12A and hull 13A of vessel 10A. Vessel 10A and outlet female housings 20A, together with outlet product lines or conduits 28A, weathervane or rotate about turret 12A, inner male core 18A, and inlet product lines or conduits 26A connected to turret 12A. A substantial height above the deck of the vessel is required between the bottom of the swivel stack and the top of turret 12A to provide manifolds, the outlets of which enter via the bottom of the stacked male core 18A.

Description of Mooring System of Present Invention—FIG. 2

FIG. 2 shows the mooring system and swivel stack arrangement of the present invention in which a schematic illustration is presented of vessel 10 which has a turret 12 mounted on suitable upper and lower bearings 11, 11' adjacent moon pool 14 of hull 13. A swivel stack 16 with a plurality of vertically spaced swivels is mounted on turret 12. Swivel stack assembly 16 has a plurality of inner male sections which when connected together form an inner male core 18 and which is secured to vessel 10. The plurality of vertically spaced outer female housings 20 are secured via torque arms to turret 12. Anchor legs 22 are secured to turret 12 and anchor it to the sea floor F. Risers 24 extend from subsea wells W (or manifolds) to upper inlet product lines 26. Such risers 24 and product lines 26 are secured to turret 12 and extend to outer female housings 20 for the product swivels. Outlet product lines 28 extend from the upper end of inner male core 18 and run to the storage holds of vessel 10. Vessel 10 and inner male core 18 rotate together with outlet product lines 28 weathervaning or rotating about turret 12. Outer female housings 20, and inlet product lines or conduits 26 do not rotate, but are fixed to turret 12.

The arrangement of inlet product lines 26 from risers 24 connected to outer female housings 20 of swivel stack 16 and outlet product lines 28 connected to inner male core 18 has several advantages. Of particular importance is the lateral connection of the inlet product lines to the outer peripheral surface of the swivel stack instead of connecting the inlet product lines to the inner male core from the lower end of the bore of the swivel stack as heretofore. The arrangement of FIG. 2 permits the lowering of the swivel stack relative to the turret and the main deck of the vessel as compared to the prior arrangement of FIG. 1, because the inlet product lines do not enter the lower end of the central bore in the swivel stack of the present invention, thereby minimizing a requirement for vertical space at the lower end of the stack for inlet product lines and manifolds on decks there. Such reduction in that vertical space translates into a shorter, cheaper and more efficient platform structure which surrounds the swivel stack as seen below by reference to FIGS. 3 and 4 described below.

DETAILED DESCRIPTION OF PREFERRED EMBODIMENT

Figure 3:
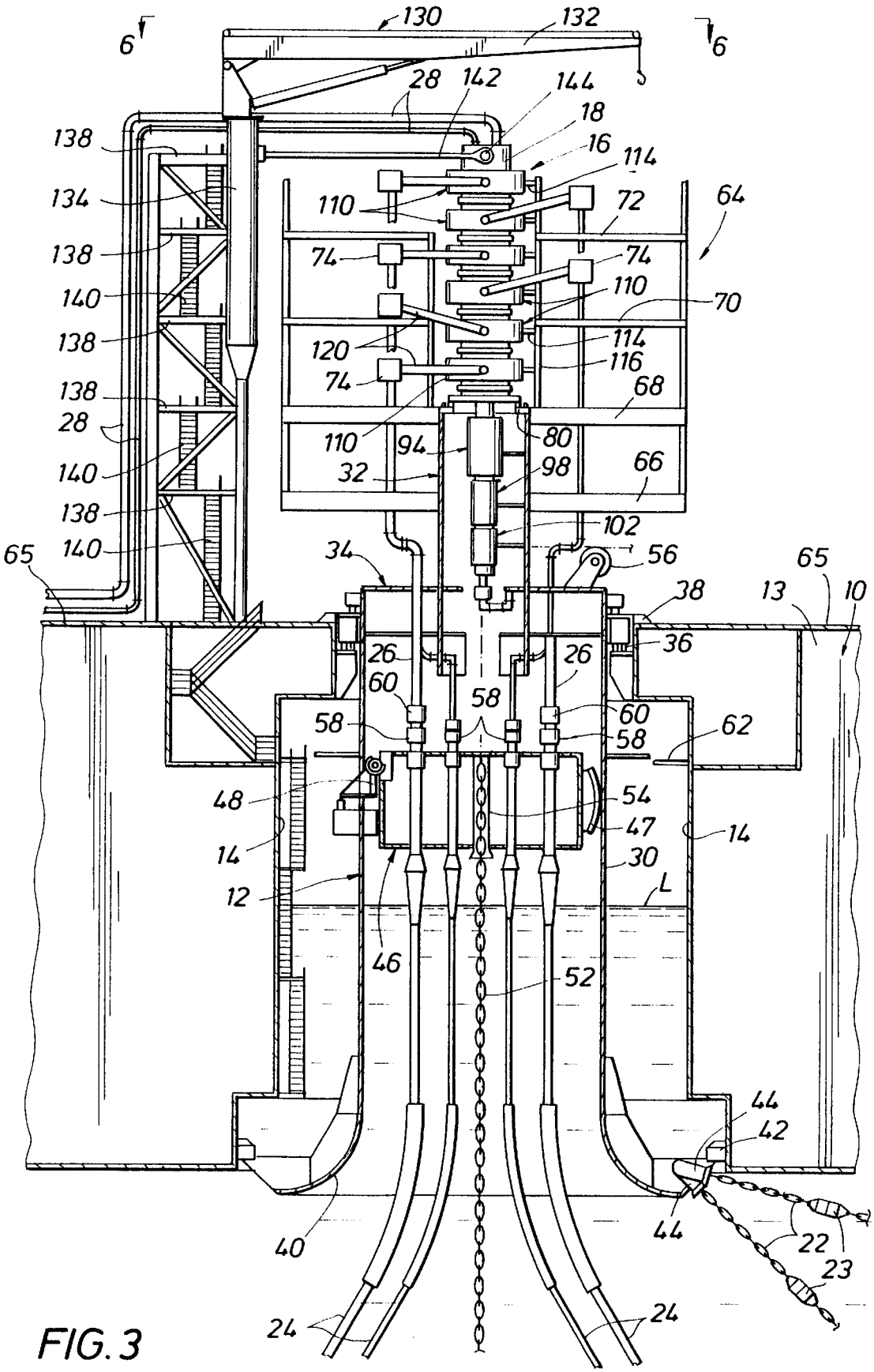
FIG. 3 is a longitudinal sectional view of the turret and swivel stack of the storage vessel which is shown schematically in FIG. 2 with risers connected to a buoy docked in the turret.
Figure 4:
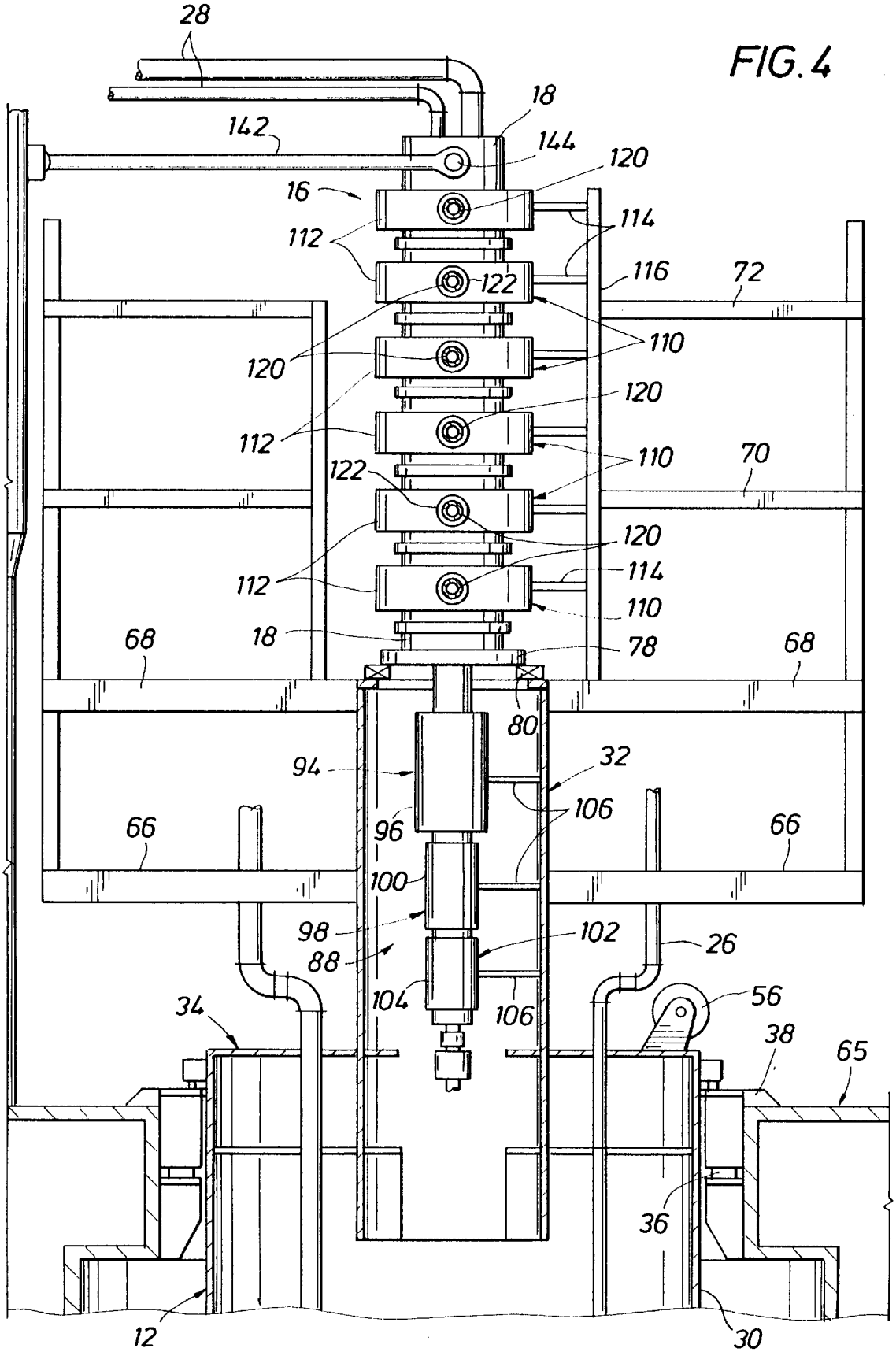
FIG. 4 is an enlarged longitudinal sectional view of a portion of the swivel stack and turret shown in FIG. 3 and shows a lower end portion of the swivel stack extending downwardly within an upper end portion of the turret.

Referring now particularly to FIGS. 3 and 4, turret 12 and swivel stack assembly 16 are illustrated. Vessel 10 has a hull 13 with a moon pool 14 in which turret 12 is mounted. Turret 12 includes a lower large diameter cylindrical end portion 30 and an integral upper small diameter cylindrical end portion 32. An upper support ring 34 defines the upper end of lower end portion 30 and is mounted with respect to the vessel by upper vertical bearing 36 and upper radial bearing 38 which define upper bearing 11 as shown in FIG. 2. The lower end of large diameter end portion 30 has an outwardly flared fender 40 with a lower radial bearing 42 which engages adjacent hull 13 of vessel 10 and is representative of lower radial bearing 11' of FIG. 2. Anchor legs 22 are connected to chain support assemblies 44 which are pivotally mounted on foot 40 for anchoring turret 12 to sea floor F. Emergency release links 23 are provided for quickly disconnecting the vessel 10 from its mooring.

Risers 24 are connected at their upper ends to a disconnectable riser buoy 46 shown in a docked position within turret 12 at a position above sea water level L. Hydraulically actuated arms 48 mounted on hull 13 secure buoy 46 in a releasably locked position. Spaced bumpers 47, preferably of an elastomeric material, are spaced about the outer periphery of riser buoy 46. A retrieval chain 52 is slidably secured with a guide tube 54 on buoy 46. It is pulled upwardly by winch 56 via a chain jack assembly and sheave arrangement (not shown) and is used to pull buoy 46 upwardly into turret 30 to a docked position. Details of a suitable jack assembly and sheave arrangement may be obtained by reference to pending U.S. application Ser. No. 08/862,593 and U.S. Pat. No. 5,306,186, both of which are assigned to the assignee of this application and are incorporated by reference herein. A stopper (not shown) on the end of chain 52 engages the lower end of guide tube 54 for pulling riser buoy 48 upwardly. Quick disconnect couplings 58 are mounted on the upper end of buoy 46 and are connected to couplings 60 on turret 12 when riser buoy 46 is docked. Workmen on platform 62 above the level L of sea water are able to work on buoy 46 when it is docked in a dry location.

An alternative arrangement for connecting riser buoy 46 to turret 30 may be provided with a hydraulic connector mounted on the turret for latching and tensioning a hub on the riser 46. Such an arrangement is disclosed in U.S. Pat. No. 5,306,186 and is incorporated by reference herein.

While it is preferred to land riser buoy 46 above sea level L in moon pool 14, it may alternatively be connected to the turret 12 below sea level L in the moon pool 14 with riser piping running from quick disconnect assemblies at the top of the buoy to the main deck and manifold platforms. A deck assembly shown generally at 64 is supported from small diameter upper turret end portion 32 above main deck 65 and extends upwardly therefrom about and alongside swivel stack 16. Deck assembly 64 includes a lower control deck 66, a lower manifold deck 68, an intermediate manifold deck 70, and an upper manifold deck 72. The number of manifold decks required depends on the required number of risers for a particular project. Inlet product lines 26 via riser buoy 46 from risers 24 are connected to suitable manifolds 74 on manifold decks 68, 70, and 72.

Figure 5:
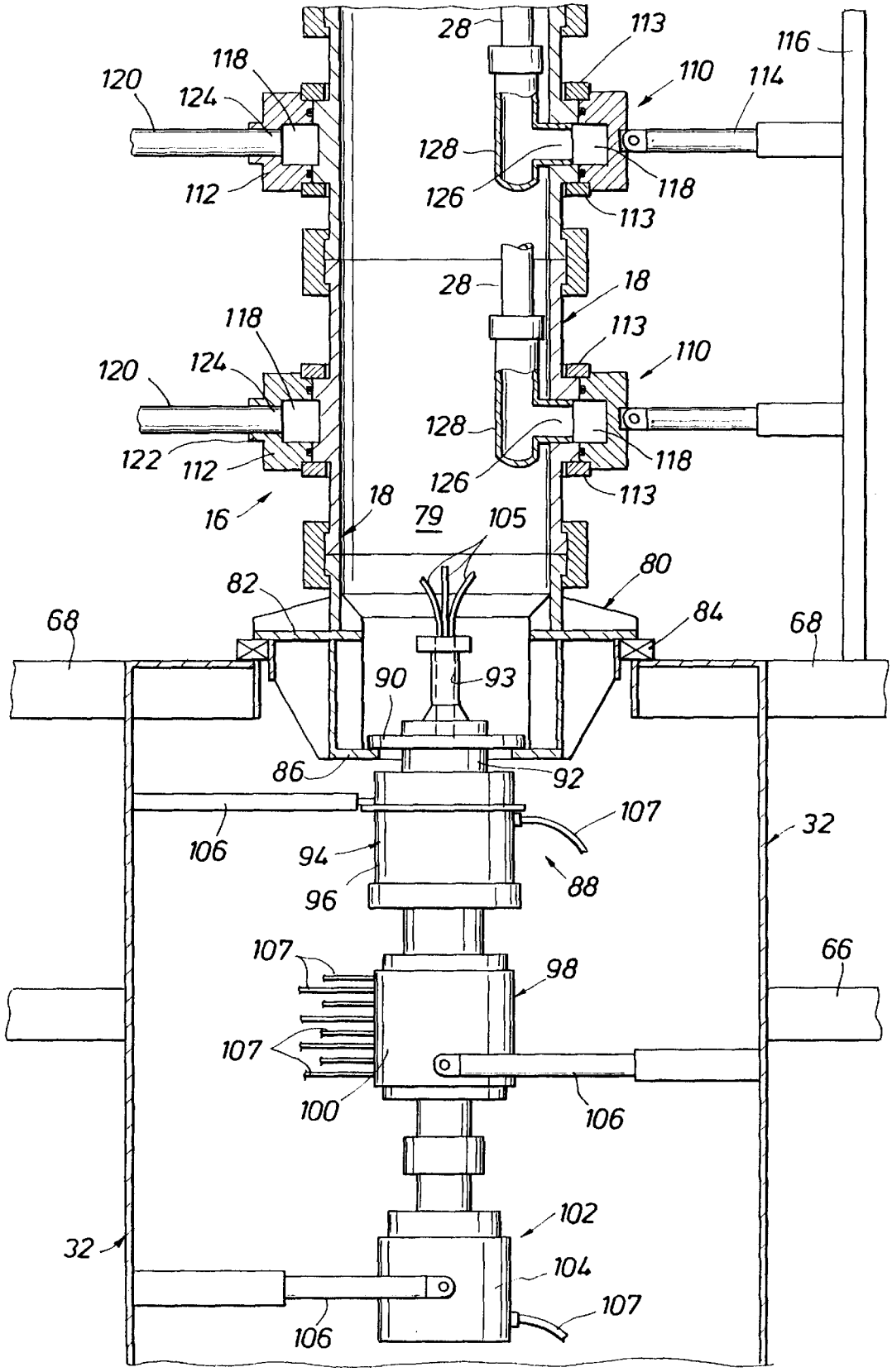
FIG. 5 is an enlarged elevational view (partially in section) of the swivel stack assembly showing inlet product lines connected to the outer female housings of the swivels and outlet product lines extending from the inner male core.

As shown in FIG. 5 swivel stack assembly 16 has an inner male stacked core 18 which extends the length of stack assembly 16 above upper end portion 32 of turret 12. Stacked male core 18 has a central bore 79 and a lower body assembly generally indicated at 80 secured thereto. Lower body assembly 80 has an annular bearing plate or ring 82 mounted on bearing 84. Bearing 84 is mounted on the upper end of small diameter turret end portion 32 as shown particularly in FIGS. 4 and 5.

Lower swivel body assembly 80 has an inwardly extending annular support plate 86 and a lower auxiliary swivel stack generally indicated at 88 having an upper supporting flange 90 fastened to support plate 86. Lower auxiliary swivel stack 88 includes an inner male core 92 having a central bore 93. A plurality of auxiliary swivels are mounted on lower auxiliary stack 88, such as an electrical swivel 94 having an outer female housing 96, a hydraulic swivel 98 having an outer female housing 100, and a control swivel 102 having an outer female housing 104. Outer female housings 96, 100, and 104 are connected by arms 106 to upper turret end portion 32 so that inner core 92 may rotate relative to housings 96, 100, 104 and turret 12. Suitable hydraulic, electrical, and control conduits 105 extend within bore 93 of inner male core 92 to swivels 94, 98 and 102 as required for a specific installation. Suitable leads on conduits 107 extend from outer female housings 96, 100, and 104 downwardly through turret 12 to conduits of one or more risers to subsea wells W for control thereof.

Swivel stack assembly 16 has a plurality of vertically spaced production swivels 110 above bearing 80 with each swivel 110 having an outer female housing 112 mounted on upper and lower bearings 113 about stacked male inner core 18. Arms 114 have their inner ends secured to female housings 112 and their outer ends secured to a vertical rod 116 which is fixed to platforms 68, 70 and 72. Thus, outer female housings 112 are substantially held against rotation of weathervaning rotation of vessel 10 and inner male core 18 about turret 12/32.

Outer female housings 112 include toroidal fluid paths 118 with inner male core 18. The inner male core 18 is formed by stacking various swivel elements and securing the inner male cores of each together. Inlet product lines 120 from manifolds 74 extend to fittings 122 and inlet port 124 for supply of product from inlet product line 120 to toroids 118. An outlet port 126 of each swivel of the stack in stacked inner male core 18 extends to an outlet fitting 128 as shown particularly in FIG. 5. Outlet product lines 28 are connected to outlet fittings 128 and extend upwardly through central bore 79 and out the upper end of swivel stack assembly 16 to suitable holds within vessel 10 for product storage. The fluid flow swivels 110, if desired, may be used for fluids from wells W other than hydrocarbon product such as water or flare gas, for example.

Figure 6:
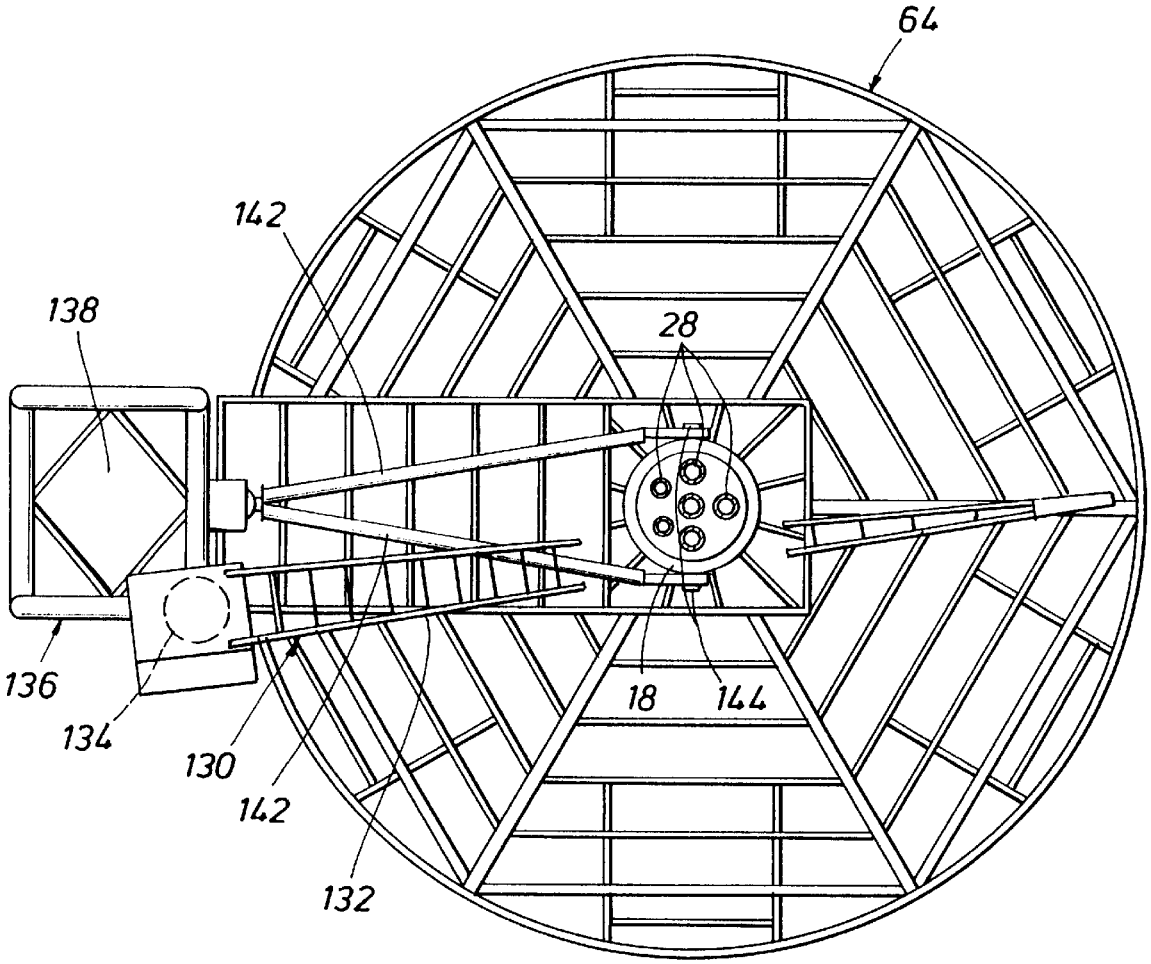
FIG. 6 is a top plan view of the swivel stack and turret as seen generally along line 6—6 of FIG. 3 and shows a crane mounted over the swivel stack and an arm for supporting and providing torque to the upper end portion of the male core of the swivel stack and showing outlet product lines which extend from the central bore of the inner male core of the swivel stack.

As shown in FIGS. 3 and 6, an overhead crane is provided generally at 130 and has an upper horizontal arm 132. A vertical post 134 is secured to the main deck 65 of vessel 10 to support arm 132 for pivotal movement. Crane 130 may be used for repair and servicing of swivel stack assembly 16. To provide access to swivel stack 16 and to platforms 66, 68, 70 and 72 from main deck 65, a stair well generally indicated at 136 (see FIG. 6) and supported on main deck 65 extends upwardly from deck 65 alongside crane 130. Platforms 138 and ladders 140 on stair well 136 (which rotate with a weathervaning vessel 10) provide access to platforms or decks 66, 68, 70 and 72 which are secured to a substantially stationary turret 12. A pair of support arms 142 are mounted on upper platform 138 and are connected at 144 to the upper end of the stacked inner male core 18 in order to provide a torque arm to the inner male core 18 of the swivel stack 16 to enhance its rotation with the vessel 10 about the substantially stationary turret 12.

From the above, it is apparent that hydrocarbon product from subsea wells may be transported from risers 24 through inlet product lines 26 and 120 to outer female housings 112 of swivels 110. Product from inlet product lines 120 is communicated through inlet ports 124 to toroids 118, then through outlet ports 126 to outlet fittings 128 connected to outlet product lines 28 within central bore 79 of inner male core 18, and then to suitable holds for storage. Substantial advantages result from the provision of a mooring system having a swivel stack assembly mounted on a turret with a stacked inner male core that is secured to the vessel for weathervaning with the vessel about the turret which is anchored to the sea floor. An important advantage is in having inlet product lines from risers secured to outer female housings of the swivels while outlet product lines from the inner male core extend upwardly through the central bore of the swivel stack and out the upper end of the swivel stack. As a result, the swivel stack extends upwardly only a minimal height from the main deck of the vessel such that manifold and service platforms 64 may be lower in height with resulting functional and economic advantages.

The preferred embodiment of the mooring system and swivel stack arrangement of FIG. 3 includes a riser buoy 46 which may be disconnected quickly from vessel 10 (with the risers 24 capable of quick disconnection also) and submerged below the sea surface while supporting risers beneath the sea surface. Anchor chains 22 may be quickly disconnected from vessel 10 if desired by actuating emergency release links 23. Alternatively, buoy 46 may carry anchor chains 22, and when disconnected from the turret 30, the buoy 46, risers 24 and anchor legs 22 all submerge beneath the sea thereby allowing the vessel 10 to be moved to another location. Alternatively, anchor legs 22 may be permanently secured to turret 30 and buoy 46 used as a means for assembling riser connections from risers from subsea wells and connecting them to a storage or production vessel 10.

While a preferred embodiment of the present invention has been illustrated in detail, it is apparent that modifications and adaptions of the preferred embodiment may occur to those skilled in the art after reading the above disclosure. Nevertheless, it is to be expressly understood that such modifications and adaptations are within the spirit and scope of the present invention as set forth in the following claims.

What is claimed is:

1. A mooring arrangement for a floating vessel for receiving hydrocarbon product comprising, a turret coupled to risers which extend to the sea floor;

a plurality of anchor lines coupled to said turret and anchored to the sea floor;

first bearing means for rotatably coupling said vessel to said turret;

a swivel stack of a plurality of vertically spaced product swivels each having an inner male swivel core and an outer coaxial female swivel housing which receives each said inner male core; said stacked inner male swivel cores defining an inner male swivel core stack with said outer female swivel housing stack having an outer periphery and said inner male swivel core stack having a bore defining an inner periphery;

second bearing means for rotably coupling said inner male swivel core stack to said turret;

inlet product lines carried by said turret and connected at respective first ends to said risers and connected at respective opposite ends to said outer female housings;

outlet product lines carried by said vessel and each connected to a respective inner male core within said bore for transport of product to storage areas of said vessel; and a platform carried by said turret and disposed alongside said swivel stack, where said inlet product lines are mounted on said platform and extend from said platform to said outer female housings for connection thereto.

2. The mooring arrangement of claim 1 wherein, a plurality of vertically spaced manifold platforms are secured to said turret and positioned alongside said vertically spaced product swivels of said swivel stack, whereby said vessel and said inner male swivel core stack weathervane about said manifold platforms and said turret.

3. The mooring arrangement of claim 2 wherein, said inner male swivel core stack includes an upper end portion above an uppermost product swivel of said plurality of vertically spaced product swivels, and said outlet product lines extend upwardly within said bore of said inner male swivel core stack and out said upper end portion to said product storage areas of said vessel.

4. The mooring arrangement of claim 3 further comprising:

an arm member carried by said vessel and connected to said upper end portion of said swivel stack to provide torque force to said inner male swivel core stack of said swivel stack when said vessel weathervanes about said turret and said manifold platforms.

5. A swivel stack assembly arranged and designed to be mounted on a turret which is carried within a vertical opening in the hull of a vessel via a bearing assembly, the turret having risers coupled thereto for the transport of product from the sea floor; said swivel stack assembly comprising:

a plurality of vertically spaced product swivels, each product swivel having an inner male core and an outer female housing mounted on said inner male core; said inner male core of said product swivels connected together to form an inner male stack core, said inner male stack core having a central bore and an upper end portion above an uppermost product swivel;

bearing means for rotatively coupling said inner male stack core to said turret for rotation with said vessel about said turret and said outer female housing;

a plurality of inlet product lines on said turret in fluid communication with said risers with each inlet product line coupled to at least one of said outer female housing of said vertically stacked product swivels; and a plurality of outlet product lines coupled to said inner male cores and in fluid communication with at least one of said inlet product lines; each of said outlet product lines extending upwardly within said central bore and out said upper end portion of said inner male stack core and above said uppermost product swivel thereof for transfer of product to storage areas of said vessel.

6. A swivel stack assembly of claim 5 further comprising:

a torque arm secured between said vessel and said inner male stack core for providing torque to said inner male stack core when said vessel weathervanes about said turret on said bearing assembly.

7. A swivel stack assembly of claim 6 wherein:

said swivel stack has a lower end portion which extends downwardly from said bearing means and is received within said turret, said lower end portion having a plurality of vertically spaced auxiliary swivels thereon.

8. A floating storage vessel arranged and designed to receive and to store hydrocarbon product there in from risers which extend to subsea wells; said floating storage vessel comprising:

a hull having a main deck and a moon pool with sea water therein;

a turret which is anchored to the sea floor and has a lower turret portion disposed below said main deck within said moon pool and an upper turret portion which extends above said main deck;

first bearing means adjacent said moon pool for rotatively mounting said turret with respect to said vessel for enabling weathervaning of said vessel about said turret;

a swivel stack of a plurality of vertically spaced swivels which extend upwardly from said upper turret portion; said swivel stack having an inner male stack core formed from inner male cores of said vertically stacked swivel, with said inner male stack core having a bore therein and a plurality of outer vertically spaced female housings mounted about said inner male stack core;

second bearing means disposed on said turret for mounting said inner male stack core thereon for rotation of said inner male stack core about said turret when said vessel weathervanes about said vessel;

a plurality of inlet product lines on said turret in fluid communication with said risers and coupled to said outer female housings; and a plurality of outlet product lines coupled to said inner male stack core of vertically stacked swivels and in fluid communication with said inlet product lines for transport of hydrocarbon product to storage areas of said vessel.

9. The floating storage vessel of claim 8 wherein:

said outer female housings are coupled to said turret to prevent rotation thereof with respect to said inner male stack core; and said inner male stack core is coupled to said hull to provide torque to said inner male stack core for rotation about said turret when said vessel weathervanes about said turret.

10. The floating storage vessel of claim 8 wherein:

said outlet product lines extend upwardly within said bore of said inner male stack core.

11. The floating storage vessel of claim 8 wherein:

said swivel stack has a lower end portion which extends downwardly from said second bearing means and is received within said turret; and said lower end portion includes a plurality of vertically spaced auxiliary swivels thereon.

12. The floating storage vessel of claim 8 wherein:

a plurality of vertically spaced manifold decks are secured to said turret and are positioned alongside said swivel stack to provide access thereto.

13. The floating storage vessel of claim 8 further comprising:

a riser buoy positioned within said lower turret portion within said moon pool for carrying said risers thereon.

14. The floating storage vessel of claim 13 wherein:

said riser buoy is disconnectably docked within said turret at a location above a sea water level in said moon pool to provide dry access to said risers for coupling to said inlet product lines.

15. The floating storage vessel of claim 8 wherein:

said lower turret portion includes a lower large diameter cylindrical portion which extends below said deck, said upper turret portion includes an upper small diameter cylindrical portion which extends above said deck; and said second bearing means is mounted on said small diameter cylindrical end portion.

16. The floating vessel of claim 15 wherein:

a plurality of vertically spaced manifold decks are carried by said upper small diameter turret cylindrical portion and are positioned alongside said swivel stack to provide access thereto.

17. A mooring system for a floating vessel arranged and designed for weathervaning about a turret to which product risers extend to the sea floor comprising, a plurality of anchor lines secured to said turret and anchored to the sea bed;

a swivel stack mounted on said turret and having a plurality of vertically spaced product swivels each having an inner male swivel core and an outer coaxial female swivel housing which receives said inner male core; said outer female swivel housing having an outer periphery and said inner male swivel cores defining a male swivel stack core having a bore defining an inner periphery;

swivel bearing means disposed on said turret for mounting said male swivel stack core for rotation relative to said turret;

inlet product lines fixed to said turret, each of said inlet product lines connected between one end of one of said risers and to one of said outer female housings of said swivel stack; and outlet product lines fixed to said vessel with each outlet product line coupled to one of said inner male swivel cores of said male swivel stack core within said bore and extending upwardly within said bore for transport of product to storage areas of said vessel.

18. The mooring system of claim 17 wherein:

each product swivel includes an inner portion defined by said inner male core and an outer coaxial portion defined by said outer coaxial female housing and a toroidal conduit positioned between said inner portion of each of said product swivels and the outer portion of each said product swivels.

19. The mooring system of claim 17 further comprising:

a platform carried by said turret adjacent said swivel stack, said inlet product lines being mounted on said platform and extending from said platform to said outer female housings for connection thereto.

20. The mooring system of claim 17 wherein:

said floating vessel has a hull with a vertical opening therein;

turret bearing means are carried by said hull for rotative mounting of said turret within said vertical opening of said hull;

said turret has an upper end portion which extends upwardly above said hull;

said swivel bearing means on said turret for said inner male swivel core is positioned on said upper end portion of said turret;

said upper end portion of said turret is generally cylindrical; and said swivel stack has a lower end portion which extend within and is received by said upper end portion of said turret.

21. The mooring system of claim 20 further comprising:

a platform fixed to said upper end portion; and manifolds mounted on said platform and connected to said inlet product lines and to said outer female housings of said swivel stack.

22. The mooring system of claim 20 wherein;

said lower end portion of said swivel stack includes a plurality of auxiliary swivels received within said upper end portion of said turret below said turret bearing means and coupled to said male swivel stack core, said auxiliary swivels including a hydraulic swivel for hydraulic fluid and an electrical swivel for electrical conduits.

23. The mooring system of claim 17 wherein;

said floating vessel has a hull with a vertical opening therein and said turret is mounted on said hull within said vertical opening; said turret being generally cylindrical with the sea water level within said vertical opening being intermediate the height of said turret; and a riser buoy received within said turret and supporting said risers thereon.

24. The mooring system of claim 23 wherein;

said riser buoy is releasably docked within said turret; and couplings are provided between said risers on said buoy and said inlet product lines on said turret for the transport of product from said risers to said inlet product lines.

25. The mooring system of claim 24 wherein;

said riser buoy is releasably docked within said turret at a position above sea water level whereby dry access is provided to said couplings.

26. A mooring system for a floating vessel having a hull with a vertical opening therethrough;

a turret mounted within said vertical opening and supported within said hull so that said vessel can rotate about said turret;

a plurality of anchor lines secured to said turret and anchored to the seabed for mooring the floating vessel;

a swivel assembly mounted on said turret including an inner male core and an outer female housing, said outer female housing having a fluid inlet and said inner male core having a fluid outlet;

means for mounting said inner male core to said hull for rotation with said vessel about said turret and within said outer female housing;

a riser extending from a subsea well to said turret;

an inlet product line on said turret which is in fluid communication with is in fluid communication with said fluid inlet of said outer female housing of said swivel assembly;

an outlet product line connected to said inner male core and in fluid communication with said fluid outlet of said inner male core of said swivel assembly for transport of product to a storage area; and means providing fluid communication between said fluid inlet of said outer female housing and said fluid outlet of said inner male core.

27. The mooring system of claim 26 further comprising;

means for coupling said outer female housing to said turret to prevent rotation of said outer female housing with respect to said inner male core of said swivel assembly.

28. The mooring system of claim 26 wherein;

said inner male core has a central bore and said outlet product line extends upwardly within said central bore from said fluid outlet and out the upper end of said inner male core.

29. The mooring system of claim 26 wherein;

said means for providing fluid communication between said fluid inlet and said fluid outlet comprises a toroidal flow path between said inner male core and said outer female housing.

30. The mooring system for a floating vessel having a hull with a vertical opening therethrough comprising:

a turret mounted within said vertical opening and supported by said hull for rotation of said vessel about said turret;

a plurality of anchor lines secured to said turret and anchored to the seabed for mooring the floating vessel;

a plurality of product risers extending from subsea wells to said turret;

a swivel stack mounted on said turret and extending upwardly therefrom, said swivel stack having a plurality of vertically spaced swivels thereon;

said swivel stack having an inner male core extending through said plurality of swivels for substantially the entire height of said stack and having a central bore with an upper end portion above the uppermost swivel;

an outer female housing mounted about said inner male core for each of said vertically spaced swivels;

means for coupling said outer female housings to said turret to prevent relative rotation between said outer female housing and said turret;

means for coupling said inner male core to said hull for rotation with said vessel about said turret and within said outer female housings;

a plurality of inlet product lines on said turret in fluid communication with said risers and coupled to said outer female housings; and a plurality of outlet product lines coupled to said inner male core and in fluid communication with said inlet product lines, said outlet product lines extending upwardly within said inner male core and out said upper end portion thereof for transport of product to storage areas.

31. The mooring system of claim 30 wherein:

each of said swivels has a toroidal path between said inner male core and an associated outer female housing to provide fluid communication between the outer female housings and said inner male core.

32. The mooring system of claim 30 wherein:

said turret has a relatively large diameter lower end portion extending within said vertical opening and a relatively small diameter upper end portion extending upwardly from said vertical opening; and bearing means are provided on said upper end portion for mounting said inner male core of said swivel stack for rotation relative to said turret.

33. The mooring system of claim 32 wherein:

said swivel stack has a lower stack portion received within said small diameter upper end portion below said bearing means and includes a plurality of vertically spaced auxiliary swivels.

34. The mooring system for a floating vessel of claim 33 wherein:

said auxiliary swivels include a hydraulic swivel for hydraulic fluid and an electrical swivel for electrical conduits.

35. The mooring system for a floating vessel of claim 32 wherein:

support means are provided between said hull and said upper end portion of said inner male core for transmitting torque to said main inner core when said vessel weathervanes about said turret.

* * * * *